US006114661A

United States Patent [19]

Leung

[11] Patent Number: 6,114,661

[45] Date of Patent: Sep. 5, 2000

[54] HAIR CURLER WITH SLOT ADAPTED TO RECEIVE A RAIL-LIKE HEAT CONDUCTOR

[75] Inventor: Anthony Leung, Hong Kong, China

[73] Assignee: Conair Corporation, Stamford, Conn.

[21] Appl. No.: 09/306,283

[22] Filed: May 6, 1999

[51] Int. Cl.[7] ..... A45D 2/36

[52] U.S. Cl. ..... 219/222; 219/523; 132/229; 132/269

[58] Field of Search ..... 219/222, 226, 219/535, 523, 524; 132/226, 229–231, 233, 234, 246, 247, 269

[56] References Cited

U.S. PATENT DOCUMENTS

| | | | |
|---|---|---|---|
| 547,212 | 10/1895 | Hill | 132/226 |
| 1,972,186 | 9/1934 | Davis | 219/222 |
| 2,161,202 | 6/1939 | Schleimer | 219/222 |
| 2,491,939 | 12/1949 | Tasho | 132/226 |
| 3,049,131 | 8/1962 | Leclabart | 219/222 |
| 3,464,426 | 9/1969 | Parker | 132/233 |
| 3,600,522 | 8/1971 | Tolmie | 219/222 |
| 3,889,097 | 6/1975 | Forsberg | 132/233 |
| 3,923,069 | 12/1975 | Leclabart | 132/234 |
| 4,584,462 | 4/1986 | Morrison | 219/222 |
| 4,812,616 | 3/1989 | Hong | 219/222 |
| 5,280,795 | 1/1994 | Leveque et al. | 132/245 |
| 5,294,777 | 3/1994 | Denhup | 219/225 |
| 5,979,464 | 11/1999 | Teratani et al. | 132/245 |

FOREIGN PATENT DOCUMENTS

| | | |
|---|---|---|
| 2593361 | 7/1987 | France . |
| 280909 | 4/1928 | United Kingdom . |

*Primary Examiner*—John A. Jeffery
*Attorney, Agent, or Firm*—Ohlandt, Greeley, Ruggiero & Perle, L.L.P.

[57] ABSTRACT

Hair curler which has a pair of substantially semi-cylindrical, metal members having opposed side faces. The members are joined at one end by a bridge that separates the side faces of the metal members by a distance adapted to receive a rail-like heat conductor.

11 Claims, 2 Drawing Sheets

HAIR CURLER WITH SLOT ADAPTED TO RECEIVE A RAIL-LIKE HEAT CONDUCTOR

BACKGROUND OF THE INVENTION

1. Field of the Invention

This invention relates generally to personal care devices for grooming hair. More particularly, the invention relates to hair curlers and devices for heating hair curlers.

2. Description of the Prior Art

Hair setting and curling devices are well known that include means for heating hair rollers to a selected temperature for use in the curling or setting of a woman's hair. These devices usually comprise a casing that has supports for detachably holding and heating hair rollers. When the rollers are heated to a desired temperature, they are removed from the supports. The user winds a cluster of hair around the outer surface of the heated roller and, as a result, the hair is more readily curled. The roller may be removed from the hair after only several minutes.

An example of a hair roller as described above is shown in U.S. Pat. No. 3,600,552 issued to Tolmie for Portable Electric Appliance. The Tolmie patent discloses a hair setting and curling means including hair roller means and heating apparatus therefor. The heating apparatus is provided in a casing and includes a heating plate having a plurality of spaced and parallel rail members. Hair rollers are provided that have grooves in one end adapted to be fitted over the rails thereby enabling heat to be conducted from the rail members to the rollers.

These known devices present problems and inconveniences in use. The conventional heating apparatus transfers heat from a heating element to a heater case, then from the heater case to heater posts. This method of heat conduction is inefficient because heat energy is lost to the air by conduction or convection. Thus, the conventional heating apparatus is slow and wastes energy.

Accordingly, a need exists for a more effective heating arrangement in which the path of heat conduction to a hair roller is as short as possible and in which the hair roller receives as much of the heat generated as possible.

BRIEF SUMMARY OF THE INVENTION

It is an object of this invention to provide an apparatus for quickly heating hair rollers.

It is another object of this invention to provide an energy efficient apparatus to heat hair rollers.

It is a further object of this invention to provide a hair roller specifically for use with a heater support.

The present invention is a hair curler comprising a pair of substantially semi-cylindrical, metal members having opposed side faces. The members are joined at one end by a bridge that separates the side faces of the metal members by a distance adapted to receive a rail-like heat conductor.

DETAILED DESCRIPTION OF THE INVENTION

Figure 1:
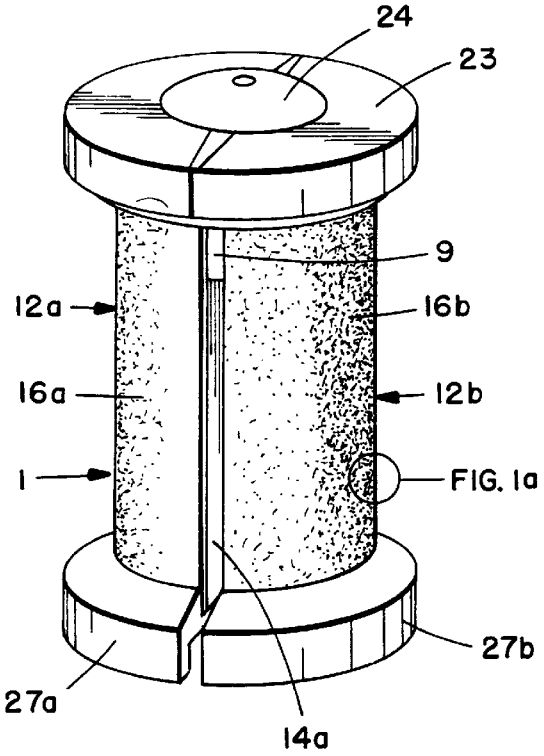
FIG. 1 is an exterior view of a preferred embodiment of a hair curler that incorporates the present invention.

FIG. 1 shows an exterior view of a preferred embodiment of the outer body, generally identified as 1, of a hair curler, that incorporates the present invention. Outer body 1 is divided into members 12*a,* 12*b*. Members 12*a,* 12*b* are preferably aluminum extrusions that have hollow regions 18*a,* 18*b* (see FIG. 2) defined by inner walls 14*a,* 14*b* (also see FIG. 2) and outer walls 16*a,* 16*b*. Members 12*a,* 12*b* are spaced apart by an integral bridge 9. A slot 7 (see FIG. 3) is thereby formed in hair curler 1 between inner walls 14*a,* 14*b*. Additionally, outer body 1 may be covered in a material, such as flocking, to enable outer body 1 to more easily grip hair wound upon it.

Figure 2:
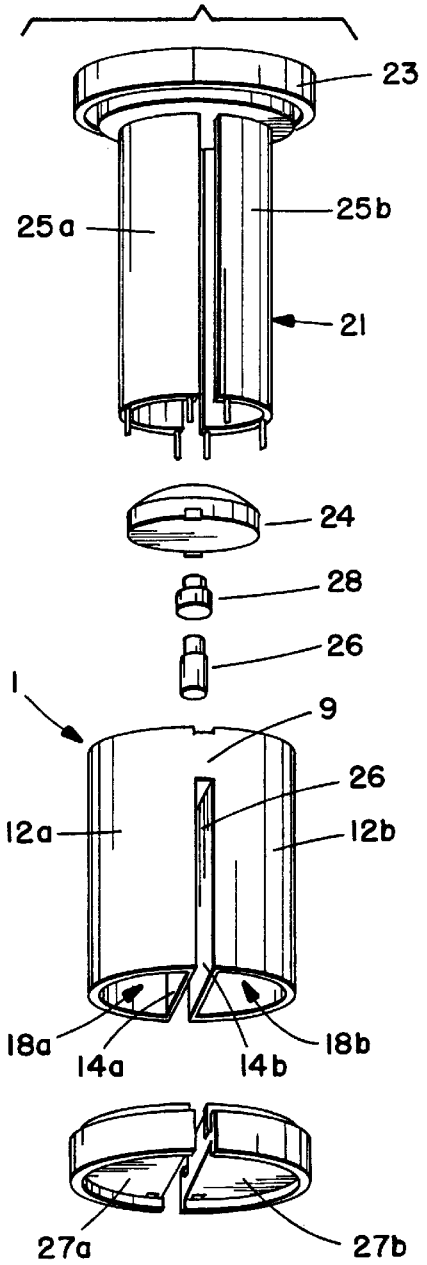
FIG. 2 is an exploded view of the hair curler of FIG. 1.
Figure 3:
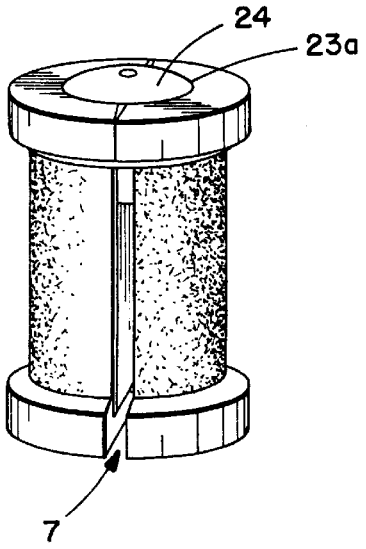
FIG. 3 is an exterior view of the hair curler of FIG. 1.
Figure 1A:
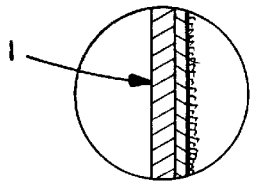
FIG. 1*a* is a cross-sectional view of the noted portion of FIG. 1.

As seen in FIG. 2, an inner member 21 comprises an endpiece 23 having a central opening 23*a* (see FIG. 3) through which endcap 24 extends. Endcap 24 may be optionally opaque or translucent Two, preferably hollow, columns 25*a,* 25*b* depend from endpiece 23. Columns 25*a,* 25*b* of inner member 21 are positioned within respective hollow regions 18*a,* 18*b* of respective members 12*a,* 12*b* of outer body 1.

The exploded view of FIG. 2 shows how the hair curler is preferably assembled. Outer body 1 is manufactured by extrusion as a hollow body having inner walls 14*a,* 14*b* and outerwalls 16*a,* 16*b*. A portion 26 of outer body 1 is cut between inner walls 14*a,* 14*b* to thereby create bridge 9 and slot 7 (see FIG. 3). Optionally, a heat pipe 26 is placed in contact with bridge 9 and a thermochromic plug 28 is placed upon heat pipe 26 so as to be visible through optionally translucent endcap 24. Columns 25*a,* 25*b* of inner body 21 are inserted into respective hollow regions 18*a,* 18*b* of respective members 12*a,* 12*b* of outer body 1. Finally, end caps 27*a,* 27*b* are connected to respective columns 25*a,* 25*b*.

Figure 4:
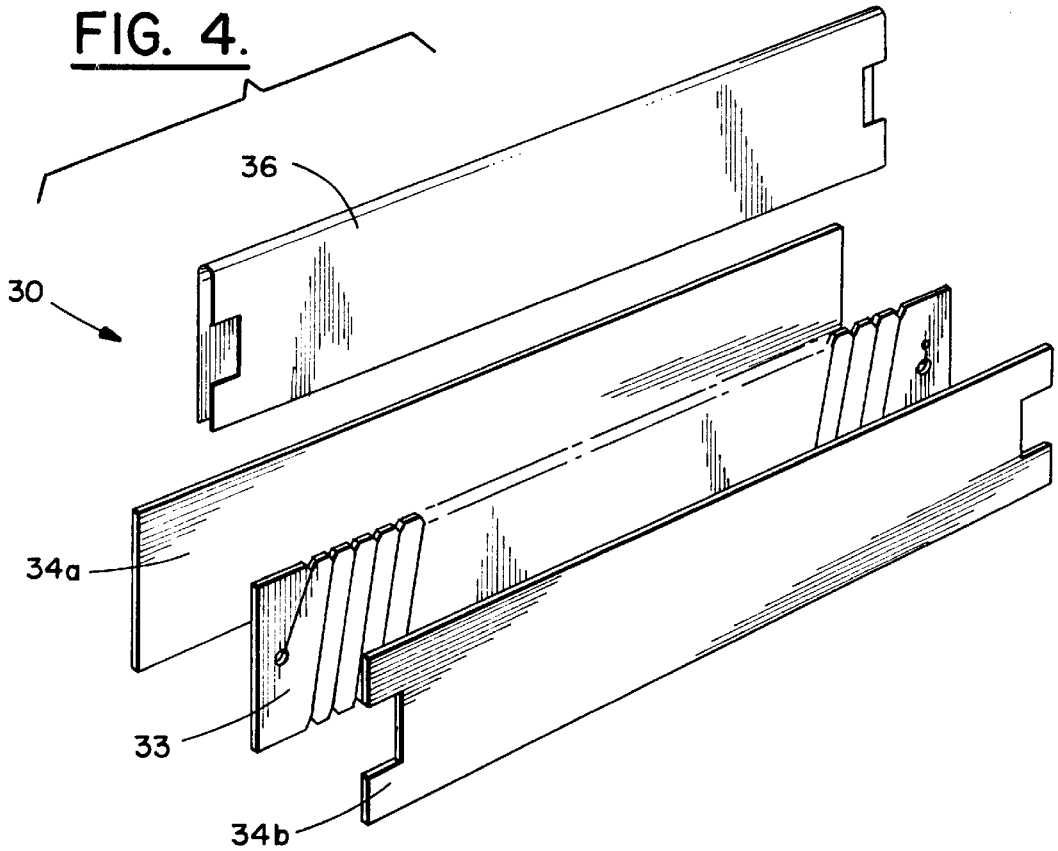
FIG. 4 is an exploded view of a preferred embodiment of a heater assembly for use with the hair curler of FIG. 1.

Heater assembly 30 is shown in FIG. 4. Heating element 33 is sandwiched between insulating layers 34*a,* 34*b*. Preferably, insulating layers 34*a,* 34*b* are mica. Sheath 36 is placed over insulating layers 34*a,* 34*b*. Sheath 36 is a heat conducting metal, most preferably, aluminum. Heater assembly 30 is proportioned to create an interference fit with inner walls 14*a,* 14*b* of hair curler 1.

Figure 5:
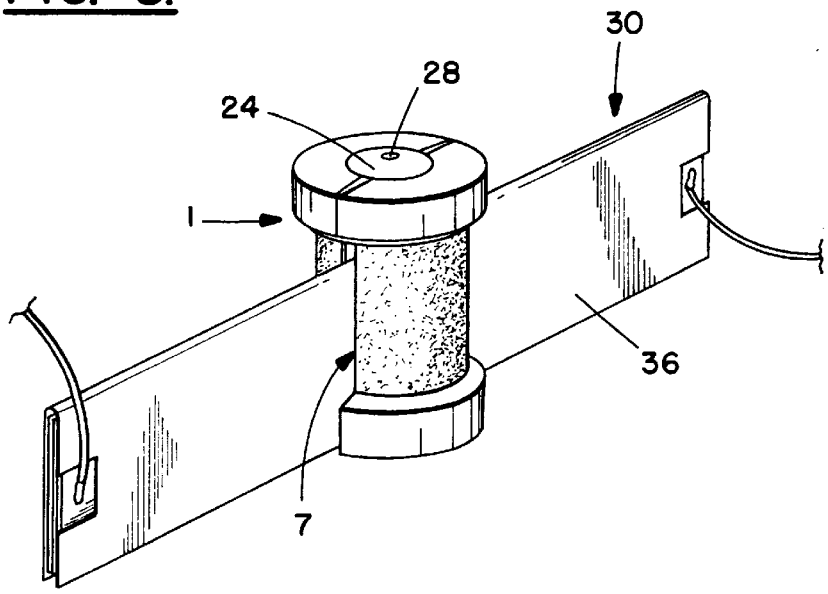
FIG. 5 is an exterior view of the hair curler of FIG. 1 placed upon the heater assembly of FIG. 4.

In operation, as shown is FIG. 5, outer body 1 is disposed upon heater assembly 30 by placing slot 7 over sheath 36. Heating element 33 of heater assembly 30 transfers heat energy through insulating boards 34*a,* 34*b* into sheath 36. Sheath 36 transfers the heat energy to inner walls 14*a,* 14*b* of hair curler 1 and also heats the air enclosed within hollow regions 18*a,* 18*b*. Inner walls 14*a,* 14*b* transfer the heat energy to outer walls 16*a,* 16*b*. Inner walls 14*a,* 14*b* also transfer the heat energy through heat pipe 26 to thermochromic plug 28. Thermochromic plug 28 changes color at a given temperature so as to notify the user that outer body 1 is ready to be used.

The invention having been thus described with particular reference to the preferred form thereof, it will be obvious that various changes and modifications may be made therein without departing from the spirit and scope of the invention as defined in the appended claims.

What we claim is:

1. A hair curler comprising:

a pair of substantially semi-cylindrical metal members having opposed, substantially planar side faces joined at one end by a bridge, said bridge separating said side faces by a distance d, said distance d creating a slot that is adapted to receive a rail-like heat conductor having a width w.

2. The hair curler according to claim 1, wherein said distance d is less than said width w of said rail-like heat conductor, thereby creating an interference fit between said side faces members and said rail-like heat conductor.

3. The hair curler according to claim 1, wherein said metal members are formed by extrusion and said bridge is an integral part thereof.

4. The hair curler according to claim 1 wherein said metal members are hollow.

5. The hair curler according to claim 1 wherein substantially the entire surface areas of said opposed side faces are adapted to contact said rail-like heat conductor.

6. The hair curler according to claim 1 wherein said slot is of inverted U-shaped configuration and said rail-like heat conductor is similarly configured in cross section.

7. A hair curler comprising:

a substantially cylindrical hollow metal body, said hollow metal body being partitioned into three sections by a pair of inner planar walls;

said metal body comprising a pair of substantially semi-cylindrical, hollow, metal members having opposed side faces joined at one end by a bridge integral thereto, said bridge formed by a cut in the material joining said hollow metal members, said cut creating a slot adapted to receive a rail-like heat conductor.

8. The hair curler according to claim 7 wherein said hollow metal body is aluminum.

9. The hair curler according to claim 7 wherein said hollow metal body is covered with flocking.

10. The hair curler according to claim 7 further comprising means for signalling that said hair curler is ready to use.

11. The hair curler according to claim 10, wherein said means for signalling is a thermochromic plug.

* * * * *